US007132009B2

(12) United States Patent
Chiang

(10) Patent No.: US 7,132,009 B2
(45) Date of Patent: Nov. 7, 2006

(54) AIR FILTER DEVICE FOR AIR EXHAUSTER

(75) Inventor: Ting-Fang Chiang, Kaohsiung (TW)

(73) Assignee: Fancy Food Service Equipment Co., Ltd., Jen-Wu Hsiang (TW)

( * ) Notice: Subject to any disclaimer, the term of this patent is extended or adjusted under 35 U.S.C. 154(b) by 49 days.

(21) Appl. No.: 10/906,819

(22) Filed: Mar. 8, 2005

(65) Prior Publication Data

US 2006/0201328 A1 Sep. 14, 2006

(51) Int. Cl.
*B03C 3/014* (2006.01)

(52) U.S. Cl. ..... 96/50; 95/64; 95/65; 95/71; 96/52; 96/74

(58) Field of Classification Search ..... 96/43–50, 96/52, 74; 95/64–66, 71
See application file for complete search history.

(56) References Cited

U.S. PATENT DOCUMENTS

| | | | | |
|---|---|---|---|---|
| 2,874,802 | A * | 2/1959 | Gustafsson et al. | 95/71 |
| 3,748,828 | A * | 7/1973 | Lefebvre | 95/64 |
| 4,222,748 | A * | 9/1980 | Argo et al. | 95/64 |
| 4,553,987 | A * | 11/1985 | Artama et al. | 96/44 |
| 4,726,814 | A * | 2/1988 | Weitman | 95/73 |
| 5,160,510 | A * | 11/1992 | Steinbacher et al. | 95/64 |
| 5,364,457 | A * | 11/1994 | Cameron | 96/27 |
| 5,601,791 | A * | 2/1997 | Plaks et al. | 422/169 |
| 6,294,003 | B1 * | 9/2001 | Ray | 96/49 |
| 6,986,803 | B1 * | 1/2003 | Richards | 95/71 |
| 6,858,064 | B1 * | 2/2005 | Bologa et al. | 95/65 |
| 2003/0200869 | A1 * | 10/2003 | Brock | 96/52 |

FOREIGN PATENT DOCUMENTS

| | | | |
|---|---|---|---|
| DE | 3928808 | * 11/1990 | 95/64 |

OTHER PUBLICATIONS

Taiwan Patent Publication No. 398607, Jul 11, 1989, 5 pages.
Taiwan Patent Publication No. 421254, Feb. 1, 1990, 7 pages.

* cited by examiner

*Primary Examiner*—Richard L. Chiesa
(74) *Attorney, Agent, or Firm*—Alan D. Kamrath; Nikolai & Mersereau, P.A.

(57) ABSTRACT

An air filter device for an air exhauster includes at least one static electricity dust-collecting module, at least one water-cleaning module and a casing. The static electricity dust-collecting module is operated to generate static electricity for electrically attracting greasy dirt and dust filled in exhaust air. The water-cleaning module mechanically connects to at least one side of the static electricity dust-collecting module, and includes a plurality of guiding members each forming a longitudinal groove for guiding water in wetting and washing greasy dirt and dust filled in exhaust air.

12 Claims, 3 Drawing Sheets

AIR FILTER DEVICE FOR AIR EXHAUSTER

BACKGROUND OF THE INVENTION

1. Field of the Invention

The present invention relates to an air filter device for an air exhauster. Particularly, the present invention relates to the air filter device having at least one static electricity dust-collecting module and at least one water-cleaning module, thereby employing static electricity and water synchronously for increasing air-filtering efficiency of the air filter device.

2. Description of the Related Art

Taiwanese Patent Publication No. 421254, entitled "static electricity range hood for modular kitchenware," discloses a static electricity range hood including a static electricity dust-collecting module and a casing. The static electricity dust-collecting module has an ionizer portion and a dust-collecting portion. The ionizer portion and the dust-collecting portion are mounted on a rack which further forms a plurality of electrode plates. Each end of the combination of the ionizer portion and the dust-collecting portion is provided with a filtering net. An inside of the casing is provided with a pair of slide tracks for receiving the static electricity dust-collecting module. The static electricity range hood employs the static electricity dust-collecting module for providing a static electricity filtering effect. Disadvantageously, the static electricity dust-collecting module, after long-term use, may be faced with greasy dirt which cannot be automatically cleaned and thus must be manually washed.

Another Taiwanese Patent Publication No. 398607, entitled "laterally cleaning sprayer for static electricity range hood," discloses a static electricity range hood including a static electricity dust-collecting module and a casing. The static electricity range hood further includes a water sprayer disposed between an air inlet and the static electricity dust-collecting module. Greasy dirt and dust may accumulate on the static electricity dust-collecting module after long-term use, which may affect exhaust air of the static electricity range hood. Once occurred, the static electricity range hood must be stopped in operation for removing the accumulated greasy dirt and dust. In cleaning operation, a supply valve is turned on to supply water to the water sprayer which has spouts for laterally spraying water on static electricity dust-collecting module. Although the water sprayer can clean and remove the greasy dirt and dust accumulated on the static electricity dust-collecting module, water may affect efficiency for generating electrostatic charges in filtering greasy dirt and dust. Consequently, static-generating operation of the static electricity dust-collecting module and water-cleaning operation of the water sprayer cannot be synchronous, that is to say, disadvantageously, water sprayed from the water sprayer cannot be used to cool or filter greasy dirt and dust synchronously during operating the static electricity dust-collecting module. In other words, the water sprayer can only clean the greasy dirt and dust accumulated on the static electricity dust-collecting module, but it cannot directly cool and filter greasy dirt and dust for increasing efficiency in filtering greasy dirt and dust when exhausting air. Hence, there is a need for improving the static electricity dust-collecting module.

The present invention intends to provide an air filter device for an air exhauster, having at least one static electricity dust-collecting module and at least one water-cleaning module. The static electricity dust-collecting module and the water-cleaning module can employ static electricity and water synchronously for double-filtering greasy dirt and dust when exhausting air. Accordingly, the air filter device may increase efficiency for filtering.

SUMMARY OF THE INVENTION

The primary objective of this invention is to provide an air filter device for an air exhauster, wherein having at least one static electricity dust-collecting module and at least one water-cleaning module. The static electricity dust-collecting module and the water-cleaning module employ static electricity and water synchronously for filtering greasy dirt and dust so as to increase filtering efficiency.

The secondary objective of this invention is to provide the air filter device for the air exhauster, wherein separately arranging at least one static electricity dust-collecting module and at least one water-cleaning module. Such an arrangement permits conveniently disassembling or reassembling the static electricity dust-collecting module and the water-cleaning module in need of repairing or cleaning.

The air filter device in accordance with the present invention includes at least one static electricity dust-collecting module, at least one water-cleaning module and a casing. The static electricity dust-collecting module is operated to generate static electricity for electrically attracting greasy dirt and dust filled in exhaust air. The water-cleaning module mechanically connects to at least one side of the static electricity dust-collecting module, and includes a plurality of guiding members each forming a longitudinal groove for guiding water in wetting and washing greasy dirt and dust filled in exhaust air.

Further scope of the applicability of the present invention will become apparent from the detailed description given hereinafter. However, it should be understood that the detailed description and specific examples, while indicating preferred embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
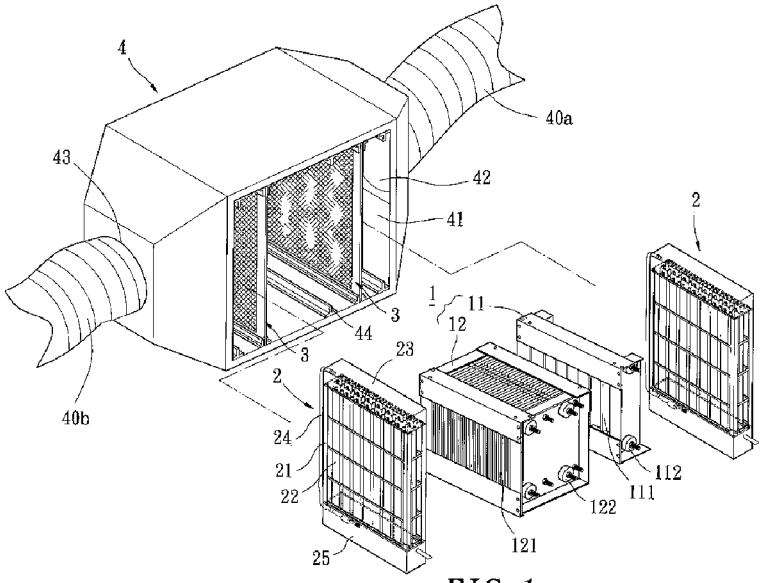
FIG. 1 is an exploded perspective view of an air filter device for an air exhauster in accordance with a first embodiment of the present invention.

Referring initially to FIG. 1, an air filter device for an air exhauster in accordance with a first embodiment of the present invention includes at least one static electricity dust-collecting module 1, at least one water-cleaning module 2, at least one filtering net 3 and a casing 4. The static electricity dust-collecting module 1, the water-cleaning module 2, the filtering net 3 are nested within the casing 4 which is connected between an air inlet conduit 40*a* and an air outlet conduit 40*b*. In filtering operation, the air filter device can filter greasy dirt and dust from exhaust air introduced from the air inlet conduit 40*a* so as to avoid exhaust air directly discharge into the atmosphere. Consequently, the filtered exhaust air can be exhausted to the atmosphere via the air outlet conduit 40*b*.

Still referring to FIG. 1, the construction of the static electricity dust-collecting module 1 shall be described in detail. The static electricity dust-collecting module 1 includes an ionizer portion 111 and a dust-collecting portion 12. In the first embodiment, the ionizer portion 11 consists of a plurality of first electrode plates 111 juxtaposed to form plural first ionizing units. Each of the first ionizing units provides with first conductive terminals 112 electrically connected with the first electrode plates 111 for conducting positive and negative electricity. In filtering operation, the first electrode plates 111 produce static electricity for electrically attracting greasy dirt and dust filled in exhaust air.

In the first embodiment, the dust-collecting portion 12 connects with the ionizer portion 11, and also consists of a plurality of second electrode plates 121 juxtaposed to form plural second ionizing units. Each of the second ionizing units is provided with second conductive terminals 122 electrically connected with the second electrode plates 121 for conducting positive and negative electricity. In filtering operation, the second electrode plates 121 further produce static electricity for electrically attracting greasy dirt and dust filled in exhaust air in addition to the operation of the first electrode plates 111 of the ionizer portion 11.

Figure 2:
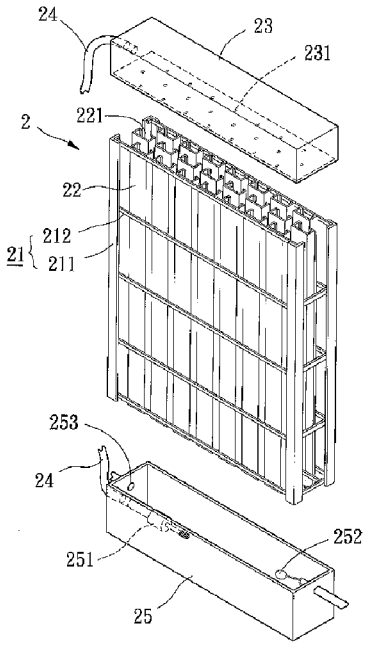
FIG. 2 is an exploded perspective view showing a water-cleaning module of the air filter device for the air exhauster in accordance with the first embodiment of the present invention.

Referring now to FIGS. 1 and 2, the construction of the water-cleaning module 2 shall be described in detail. In the illustrated first embodiment, a pair of the water-cleaning module 2 mechanically connects to either side of the static electricity dust-collecting module 1 with respect to the casing 4; namely, the static electricity dust-collecting module 1 is sandwiched in-between a pair of the water-cleaning module 2. In an alternative embodiment, the water-cleaning module 2 mechanically connects to at least one side of the static electricity dust-collecting module 1 within the casing 4. In the first embodiment, the water-cleaning module 2 includes a rack 21, a plurality of guiding members 22, a water supply trough 23, a water conduit 24 and a water-collecting reservoir 25. The rack 21 consists of upright support rods 211 and lateral support rods 212 which commonly support the guiding members 22 to form at least one or two or more guiding rows. Each guiding row has a plurality of air passages formed by the guiding members 22. Preferably, the guiding rows of the guiding members 22 are securely spaced and aligned with a flow direction of exhaust air. Each of the guiding members 22 includes a longitudinal groove 221 which has a cross section, C-shaped, V-shaped or U-shaped section for example. In use the guiding members 22 are employed to guide water in wetting and washing greasy dirt and dust filled in exhaust air. In the first embodiment, a number of the guiding rows are juxtaposed, and each of the air passages of the guiding row may be mis-aligned with those of the adjacent guiding row, namely, each of the air passages of the guiding row may be aligned with the longitudinal groove 221 of the adjacent guiding row. Under the circumstances, exhaust air cannot directly pass through the water-cleaning module 2 without sufficiently reacting with water.

The water supply trough 23 contains water output from the water conduit 24 for running through the guiding members 22. The water supply trough 23 provides with a series of water-dripping holes 231 at its bottom plate. In the first embodiment, the water-dripping holes 231 are corresponding to an inner surface of the longitudinal groove 221 of each of the guiding members 22. Connected between the water supply trough 23 and the water-collecting reservoir 25 is the water conduit 24.

The water-collecting reservoir 25 is used to collect water draining from the water-dripping holes 231 of the water supply trough 23. The water-collecting reservoir 25 includes a water pump 251, a water-level detecting switch 252 and a wastewater outlet 253. In the first embodiment, the water-level detecting switch 252 is preferably a float ball switch for detecting water level in the water-collecting reservoir 25 so as to turn on or off the water pump 251 which can pump water into the water supply trough 23. Furthermore, the water-level detecting switch 252 can decide to refill the water-collecting reservoir 25 if water level in the water-collecting reservoir 25 becomes lower than a predetermined position. Preferably, the wastewater outlet 253 is located at a relative height of the water-collecting reservoir 25 for draining wastewater from the water-collecting reservoir 25 that the collected water reservoired in the water-collecting reservoir 25 can be recycled and reused.

Referring back to FIG. 1, the construction of the filtering net 3 and the casing 4 shall be described in detail. In the illustrated first embodiment, a pair of the filtering net 3 mechanically attaches to either side of the static electricity dust-collecting module 1 within the casing 4; namely, each of the filtering net 3 is sandwiched in-between the static electricity dust-collecting module 1 and the water-cleaning module 2.

In the first embodiment, the casing 4 includes a dust-collecting compartment 41, an air inlet 42, an air outlet 43 and a plurality of slide tracks 44. Disposed either side of the casing 4 is the air inlet 42 and the air outlet 43 which are in communication with the dust-collecting compartment 41. The air inlet 42 connects with the air inlet conduit 40*a* for inputting exhaust air while the air outlet 43 connects with the air outlet conduit 40*b* for outputting filtered exhaust air. Preferably, the slide tracks 44 are parallel and extended in the dust-collecting compartment 41 which permits installing the static electricity dust-collecting module 1, the water-cleaning modules 2 and the filtering nets 3 within the dust-collecting compartment 41 of the casing 4.

Still referring to FIG. 1, in assembling, the static electricity dust-collecting module 1, the water-cleaning modules 2 and the filtering nets 3 are arranged in order. After assembling, an arrangement order from the air inlet 42 to the air outlet 43 is the water-cleaning module 2, the filtering net 3, the static electricity dust-collecting module 1, the filtering net 3 and the water-cleaning module 2. In the first embodiment, in particular, the inner surfaces of the longitudinal grooves 221 of the guiding members 22 face the air inlet 42 of the casing 4.

Figure 3:
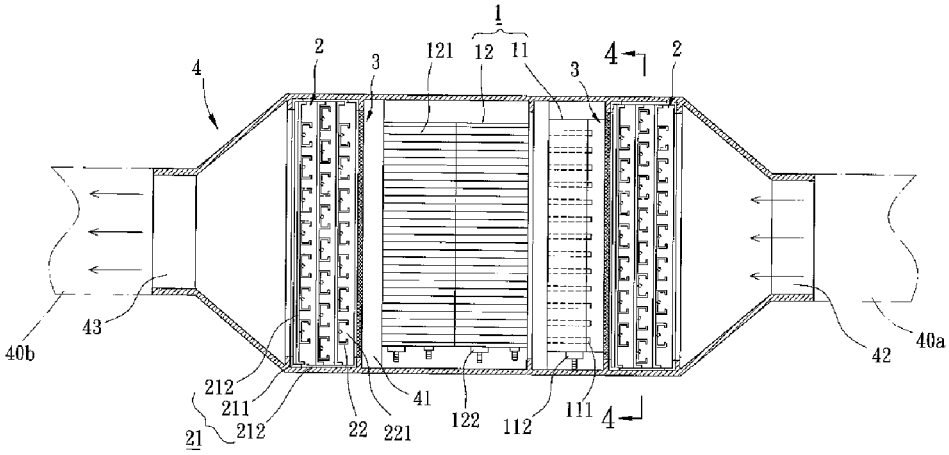
FIG. 3 is a cross-sectional view of the air filter device for the air exhauster in accordance with the first embodiment of the present invention.
Figure 4:
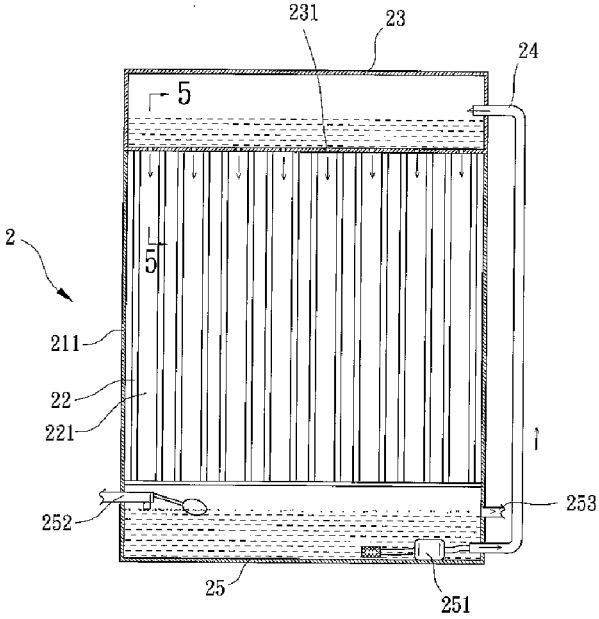
FIG. 4 is a cross-sectional view, taken along line 4—4 in FIG. 3, of the air filter device for the air exhauster in accordance with the first embodiment of the present invention.
Figure 5:
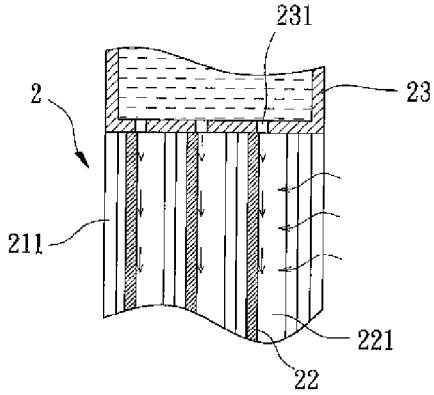
FIG. 5 is an enlarged cross-sectional view, taken along line 5—5 in FIG. 4, of the air filter device for the air exhauster in accordance with the first embodiment of the present invention.

Turning now to FIGS. 3, 4 and 5, the filtering operation of the air filter device shall be described in detail. In filtering operation, once exhaust air supplied from the air inlet conduit 40*a* enter the air inlet 42 of the casing 4, it may initially pass through the water-cleaning modules 2 proximate to the air inlet 42 of the casing 4 for firstly filtering greasy dirt and dust filled in the exhaust air. Synchronously, the water pump 251 is operated to pump water from the water-collecting reservoir 25 to the water supply trough 23 via the water conduit 24. Water may drip from the water supply trough 23 via the water-dripping holes 231, and flow along the inner surfaces of the longitudinal grooves 221 of the guiding members 22. Once occurred, the inner surfaces of the longitudinal grooves 221 of the guiding members 22 permit water having a maximum surface area in contact with exhaust air passing through the water-cleaning modules 2. Because of this, the guiding members 22 of the water-cleaning modules 2 allow moisture bonding with greasy dirt and dust. Subsequently, greasy dirt and dust may be mixed in water, and collected in the water-collecting reservoir 25. The greasy dirt and dust may be floated on water contained in the water-collecting reservoir 25 in the event, since specific weight of the greasy dirt and dust is relatively lighter than that of water. Finally, the greasy dirt and dust may be drained out from the water-collecting reservoir 25 via the wastewater outlet 253. The result is increased efficiency of the water circulation by draining the greasy dirt and dust.

The exhaust air passed through the guiding member 22 of the water-cleaning modules 2 may be meandered since each of the air passages of the guiding row may be mis-aligned with those of the adjacent guiding row. Such an arrangement results in exhaust air passed through the air passages of one of the guiding row of the water-cleaning modules 2 to be directly guided to the longitudinal groove 221 of the next adjacent guiding row. The water-cleaning module 2 may relatively mitigate a filtering workload of the static electricity dust-collecting module 1 since the water-cleaning module 2 has already filtered and cooled major greasy dirt and dust in firstly filtering operation.

Still referring to FIGS. 3, 4 and 5, after passing through the water-cleaning module 2 proximate to the air inlet 42, exhaust air passes through the filtering net 3 for collecting globules splashed out of the guiding member 22 of the water-cleaning modules 2 that may affect the static electricity dust-collecting module 1 in generating static electricity. After passing through the filtering net 3, exhaust air passes through the static electricity dust-collecting module 1. In ionizing operation, the ionizer portion 11 and the dust-collecting portion 12 of the static electricity dust-collecting module 1 produce static electricity that may electrically attract greasy dirt and dust filled in exhaust air. After passing through the static electricity dust-collecting module 1, exhaust air successively passes through the filtering net 3 and the water-cleaning module 2 for further filtering greasy dirt and dust. Finally, the filtered exhaust air may be automatically exhausted from the air outlet 43 of the casing once the exhaust air is successively filter in order of the water-cleaning module 2, the filtering net 3, the static electricity dust-collecting module 1, the filtering net 3 and the water-cleaning module 2. Advantageously, such a modular arrangement permits conveniently disassembling or reassembling the static electricity dust-collecting module 1 and the water-cleaning module 2 in need of repairing or cleaning.

Figure 6:
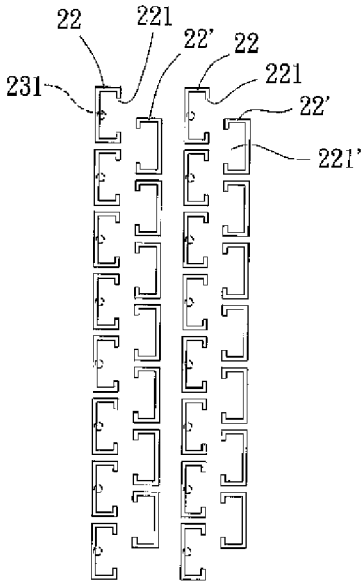
FIG. 6 is a cross-sectional view showing a series of guiding members of the water-cleaning module of the air filter device for the air exhauster in accordance with a second embodiment of the present invention.

Turning now to FIG. 6, reference numerals of the second embodiment of the present invention have applied the identical numerals of the first embodiment, as shown in FIG. 2. The construction of the water-cleaning module in accordance with the second embodiment of the present invention has similar configuration and same function as that of the water-cleaning module of the first embodiment and detailed descriptions may be omitted.

Referring now to FIG. 6, in comparison with the first embodiment, the water-cleaning module 2 of the second embodiment further includes reverse-guiding members 22' to form a guiding row in addition to the guiding members 22. The guiding rows of the guiding members 22 and the reverse-guiding members 22' are arranged in a staggered manner that the inner surfaces of the longitudinal grooves 221 of the guiding members 22 face those of the longitudinal grooves 221' of the reverse guiding members 22'. By such an arrangement, the inner surfaces of the longitudinal grooves 221 of the guiding members 22 faces the air inlet 42 of the casing 4 while the inner surfaces of the longitudinal grooves 221' of the reverse guiding members 22' face the air outlet 43 of the casing 4. Consequently, the reverse guiding members 22' may guide exhaust air into the inner surfaces of the longitudinal grooves 221 of the guiding members 22.

In filtering operation, exhaust air cannot directly pass through the water-cleaning module 2 and meanders in spaces defined between the guiding members 22 and the reverse-guiding members 22'. In the second embodiment, the water-dripping holes 231 of the water supply trough 23 are correspondingly aligned with the longitudinal grooves 221 of the guiding members 22 for dripping water. In an alternative embodiment, the water-dripping holes 231 of the water supply trough 23 may be correspondingly aligned with the longitudinal grooves 221' of the reverse-guiding members 22' for dripping water.

Figure 7:
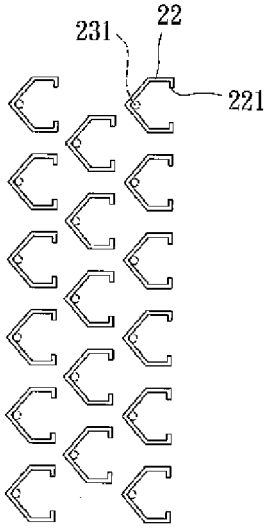
FIG. 7 is a cross-sectional view showing a series of guiding members of the water-cleaning module of the air filter device for the air exhauster in accordance with a third embodiment of the present invention.

Turning now to FIG. 7, reference numerals of the third embodiment of the present invention have applied the identical numerals of the first embodiment, as shown in FIG. 2. The construction of the water-cleaning module in accordance with the third embodiment of the present invention has similar configuration and same function as that of the water-cleaning module of the first embodiment and detailed descriptions may be omitted.

Referring now to FIG. 7, in comparison with the first embodiment, each of the guiding members 22 of the third embodiment includes a longitudinal groove 221 having a V-shaped cross section. The water-dripping holes 231 of the water supply trough 23 are correspondingly aligned with the longitudinal grooves 221 of the guiding members 22 for dripping water.

As has been discussed above, the conventional water sprayer can only clean the greasy dirt and dust accumulated on the static electricity dust-collecting module, but it cannot directly cool and filter greasy dirt and dust for increasing efficiency in filtering greasy dirt and dust when exhausting air. Referring back to FIG. 1, advantageously, the static electricity dust-collecting module 1 and the water-cleaning module 2 can employ static electricity and water synchronously for double-filtering greasy dirt and dust when exhausting air.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. An air filter device for an air exhauster comprising:

at least one static electricity dust-collecting module generating static electricity for electrically attracting greasy dirt and dust filled in exhaust air;

at least one water-cleaning module mechanically connected to at least one side of the static electricity dust-collecting module, said water-cleaning module including a plurality of guiding members each forming a longitudinal groove, said water-cleaning module further including a water supply trough and a plurality of water-dripping holes thereof aligned with the longitudinal groove for guiding water passing through therethrough; and a casing including a dust-collecting compartment, an air inlet and an air outlet, said dust-collecting compartment used to install the static electricity dust-collecting module and the water-cleaning module, said air inlet inputting exhaust air and said air outlet outputting filtered exhaust air;

wherein each longitudinal groove of the guiding members facing the air inlet of the casing and having an inner surface for guiding water in wetting and washing greasy dirt and dust filled in exhaust air.

2. The air filter device for the air exhauster as defined in claim 1, wherein the static electricity dust-collecting module including an ionizer portion and a dust-collecting portion each consisting of a plurality of electrode plates.

3. The air filter device for the air exhauster as defined in claim 1, wherein the water-cleaning module forming at least two guiding rows each having a plurality of air passages formed by the guiding members, said air passages of the guiding row mis-aligned with those of the other guiding row in a flow direction of exhaust air.

4. The air filter device for the air exhauster as defined in claim 3, wherein the water-cleaning module further including a plurality of reverse guiding members each forming a longitudinal groove, the longitudinal grooves of the reverse guiding members facing the air outlet of the casing so that exhaust air meanders in spaces defined between the guiding members and the reverse-guiding members.

5. The air filter device for the air exhauster as defined in claim 1, wherein each longitudinal groove of the guiding members having a cross section selected from a group consisting of a C-shaped section, a U-shaped section and a V-shaped section.

6. The air filter device for the air exhauster as defined in claim 1, wherein the water-cleaning module further including a water conduit and a water-collecting reservoir, the water conduit connected between the water supply trough and the water-collecting reservoir, the water-collecting reservoir used to collect water dripping from the guiding members, the water-cleaning module further including a water pump supplying water from the water-collecting reservoir to the water supply trough via the water conduit.

7. The air filter device for the air exhauster as defined in claim 6, wherein the water-collecting reservoir of the water-cleaning module further including a water-level detecting switch to detect water level in the water-collecting reservoir so as to turn on or off a water pump for refilling the water-collecting reservoir.

8. The air filter device for the air exhauster as defined in claim 7, wherein the water-level detecting switch selected from a float ball switch.

9. The air filter device for the air exhauster as defined in claim 6, wherein the water-collecting reservoir of the water-cleaning module further including a wastewater outlet located at a relative height of the water-collecting reservoir for draining wastewater.

10. The air filter device for the air exhauster as defined in claim 1, wherein the water-cleaning module connected to the side of the static electricity dust-collecting module proximate to the air inlet.

11. The air filter device for the air exhauster as defined in claim 1, wherein the water-cleaning module connected to the side of the static electricity dust-collecting module proximate to the air outlet.

12. The air filter device for the air exhauster as defined in claim 1, further comprising a filtering net sandwiched in-between the static electricity dust-collecting module and the water-cleaning module.

* * * * *